US006987395B2

(12) United States Patent
Yang et al.

(10) Patent No.: US 6,987,395 B2
(45) Date of Patent: Jan. 17, 2006

(54) DRYNESS MEASUREMENT DEVICE

(75) Inventors: Jae Suk Yang, Changwon-shi (KR); Sang Doo Kim, Changwon-shi (KR); Seong Hae Jeong, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/450,571

(22) PCT Filed: Oct. 25, 2002

(86) PCT No.: PCT/KR02/02002

§ 371 (c)(1),
(2), (4) Date: Jun. 16, 2003

(87) PCT Pub. No.: WO03/036235

PCT Pub. Date: May 1, 2003

(65) Prior Publication Data

US 2004/0036486 A1 Feb. 26, 2004

(30) Foreign Application Priority Data

Oct. 25, 2001 (KR) ..... 10-2001-0066081

(51) Int. Cl.
*G01R 27/08* (2006.01)
*F26B 3/00* (2006.01)

(52) U.S. Cl. ..... 324/694; 34/485; 34/491

(58) Field of Classification Search ..... 34/528, 34/531, 543, 546, 549–556, 575, 62–67, 34/482–486, 491; 324/694, 689, 678
See application file for complete search history.

(56) References Cited

U.S. PATENT DOCUMENTS

| | | | | |
|---|---|---|---|---|
| 3,603,805 A | | 9/1971 | Apel | 307/118 |
| 4,422,247 A | * | 12/1983 | Deschaaf | 34/550 |
| 4,470,204 A | | 9/1984 | Wesley | |
| 4,531,305 A | | 7/1985 | Nagayasu et al. | |
| 5,301,438 A | | 4/1994 | Tanaka et al. | |
| 5,367,265 A | * | 11/1994 | Gaudette | 307/650 |
| 5,757,195 A | * | 5/1998 | Bird | 324/678 |

FOREIGN PATENT DOCUMENTS

GB 2 012 934 A 8/1979

* cited by examiner

*Primary Examiner*—Anjan Deb
*Assistant Examiner*—Jeff Natalini
(74) *Attorney, Agent, or Firm*—McKenna Long & Aldridge, LLP

(57) ABSTRACT

The present invention relates to a dryness measuring device, and more particularly the dryness measuring device for sensing a dryness status of laundry in drying. The present invention is to provide an electrode sensor for sensing the dryness status of the laundry and measuring a current dryness status by a variance of a voltage which is charged in capacitor based on a variance of resistance of the electrode sensor. And, the present invention minimizes outside effect by discharging of the charged voltage of the capacitor by designated periods.

3 Claims, 4 Drawing Sheets

DRYNESS MEASUREMENT DEVICE

TECHNICAL FIELD

The present invention relates to a drier, and more particularly to a device for measuring the dryness of laundry while the laundry is dried.

BACKGROUND ART

FIG. 1 is a side sectional view of a general drier, and FIG. 2 is a plan view of the general drier.

Referring to FIGS. 1 and 2, the drier has an outer case 53 defining an outer shell thereof. A front plate 41 is connected to the leading end of the outer case 53 so as to form the front face of the drier. A drum 44 is rotatably installed inside the outer case 53 such that laundry is loaded into and dried in the drum 44. The drum 44 is rotated by a drum-drive belt 54 which surrounds the outer surface of the drum 44.

An exhaust hole 43 is formed to correspond to an inner surface of the front plate 41 and be opened toward the inside of the drum 44. The exhaust hole 43 functions to exhaust air out of the drum 44. A lint filter 36 is disposed at an entrance of the exhaust hole 43 so as to remove foreign particles contained in air.

At a portion of the exhaust hole 43, an electrode sensor 38 is disposed for detecting the dryness of laundry within the drum 44 while the laundry is dried. The electrode sensor 38 detects the dryness of laundry based upon a difference of voltages applied to both end terminals of the electrode when the laundry is in contact with the electrode 38. The electrode sensor 38 provides a microprocessor 100 with a detection signal in the form of a voltage signal. An exhaust passage 45 is placed inside the front plate 41 so as to be connected with the exhaust hole 43. A blower assembly 30 is installed so as to communicate with the exhaust passage 45. The exhaust passage 45 includes a second temperature sensor 32 for detecting the temperature of air which is exhausted out of the drum 44.

The blower assembly 30 is connected to an exhaust duct 34 for discharging air which is exhausted via the exhaust passage 45 out of the drier. The blower assembly 30 includes a blower 31 which sucks and circulates air into/in the drum 44 to introduce heat of a heater 42, and discharges moisture from laundry via the exhaust hole 43.

A feed duct 46 to feed air into the drum 44 is disposed at a portion within the outer case 53 and corresponding to a lower portion of the drum 44. The feed duct 46 feeds air into the drum 44 via a rear portion of the drum 44. A heater 42 is disposed adjacent to a portion of the feed duct 46. A temperature sensor 48 to detect the temperature of air sucked into the drum 44 is disposed in another portion of the feed duct 46.

FIG. 3 is a block diagram of components used in controlling the general drier.

A mainboard 52 is disposed in a portion within the outer case 53 so as to electrically control the operation of the drier. The mainboard 52, as shown in FIG. 3, includes a microcomputer 100 for generally controlling a drier, a drive unit 120 for driving components which should be electrically controlled within the drier, and a group of sensors 110 for detecting electric signals so as to judge the operational status of the drier.

The group of sensors 110 include: a key input unit 103 for providing the microcomputer 100 with a power supply signal, a drying operation signal and drying conditions which are selectively inputted by a user; an electrode sensor signal conversion unit 106 for converting a signal detected by the electrode sensor 38 into a signal readable by the microcomputer 100 and providing the converted signal to the microcomputer 100 so as to detect the current dryness of laundry; a first temperature sensor signal conversion unit 109 for converting a signal detected by the first temperature sensor 48 into a signal readable by the microcomputer and providing the converted signal to the microcomputer 100 so as to detect the temperature of hot air fed into the drum 44; a second temperature sensor signal conversion unit 112 for converting a signal detected by the second temperature sensor 32 into a signal readable by the microcomputer 100 and providing the converted signal into the microcomputer 100 so as to detect the temperature of hot air exhausted from the drum 44; and a door detection unit 115 for detecting the opening of a door while laundry is being dried, converting a result of the detection into a signal readable by the microcomputer 100 and providing the converted signal to the microcomputer 100.

The drive unit 120 includes a drum motor drive unit 118 for driving a drum motor (not shown) which generates driving force for rotating the drum 44, a blower motor drive unit 121 for generating driving force for rotating the blower 31 and a heater drive unit 124 for supplying heat source for drying laundry via the feed duct 46.

FIG. 4 illustrates a construction of the second temperature sensor signal conversion unit shown in FIG. 3.

Referring to FIG. 4, when the electrode sensor 38 is in contact with laundry circulating within the drum 44, the resistance value of the electrode sensor 38 is varied depending upon the dryness of laundry. The microcomputer 100 measures the dryness of laundry by receiving the resistance valve of the electrode sensor 38 varied with the dryness of laundry and a voltage divided by a resistor R1.

A dryness measuring device having the electrode sensor 38 and the resistor R1 uninterruptedly outputs detection values regardless of a time point of when the microprocessor 100 detects the dryness, and the detection values are continuously inputted into the microcomputer 100. The microcomputer 100 measures the dryness based upon the detection values which are inputted before and after the time point of a dryness measurement and which are currently being inputted. In other words, at the time point of measurement, the dryness is influenced by the detection values before and after the time point of the dryness measurement.

For example, where the electrode sensor 38 has a resistance value variable under the external influence, the resistance value is directly applied to a detection value, which may be used in dryness measurement together with other detection values which are being continuously detected. As a result, the microprocessor 100 fails to precisely measure the dryness owing to the resistance value which is under the external influence at the time point of the measurement.

DISCLOSURE OF THE INVENTION

Accordingly, the present invention is directed to a dryness measuring device that substantially obviate one or more of the problems due to limitations and disadvantages of the related art.

An object of the present invention is to provide a dryness measuring device in which any external influence is reduced.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a dryness measuring device includes: a drum disposed rotatably and for receiving objects to be dried therein; detection means for detecting the dryness of the objects, the detection means including an electrode sensor which is disposed contactable by the objects, a capacitor for charging a voltage according to resistance variation occurring when the objects is in contact with the electrode sensor and a discharging circuit for discharging the charged voltage from the capacitor; and control means for operating the discharging circuit to discharge the charged voltage from the capacitor and measuring the current dryness based upon variation of a voltage which is newly charged into the capacitor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
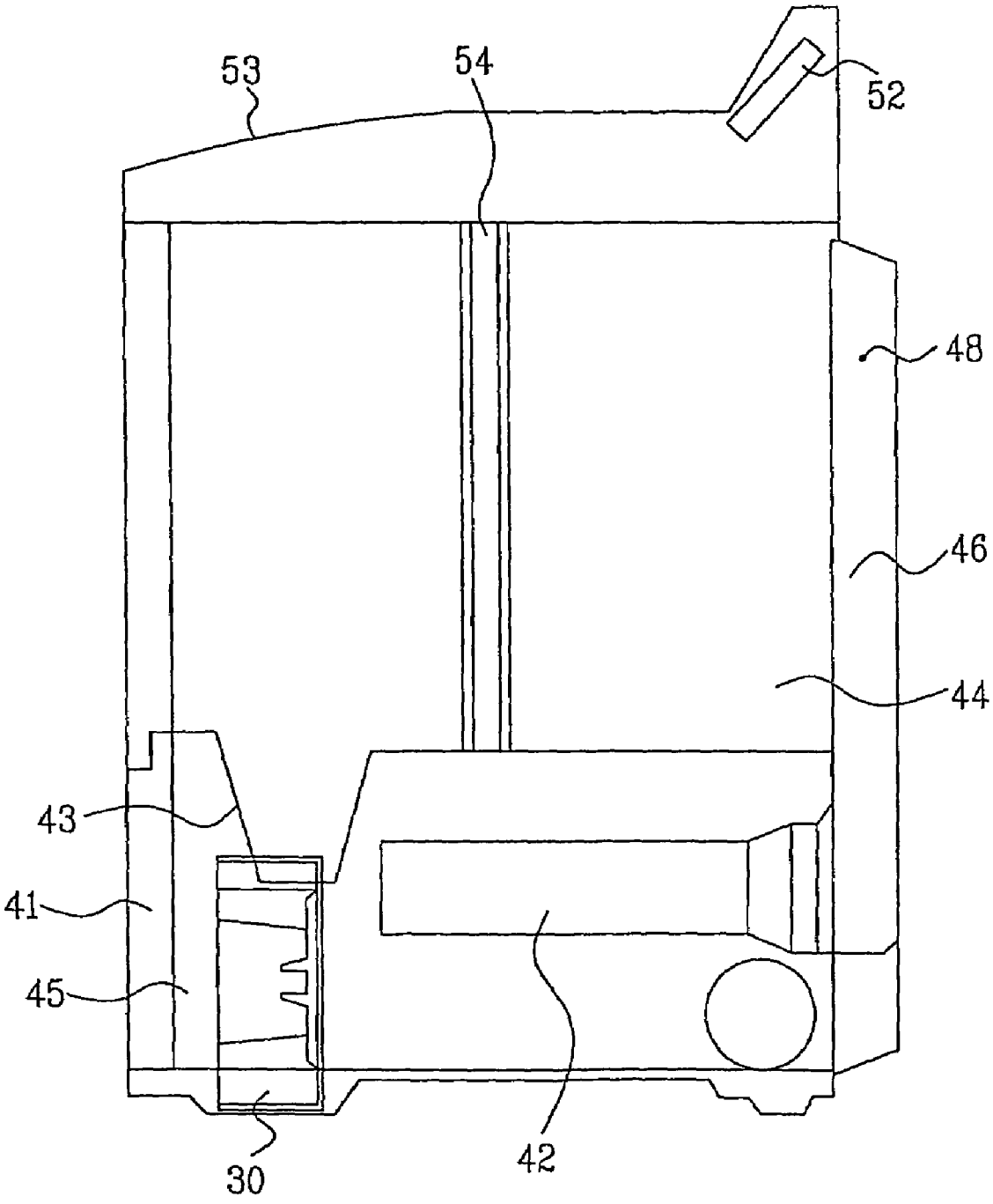
FIG.1 Related Art
FIG. 1 is a side sectional view of a general drier.
Figure 2:
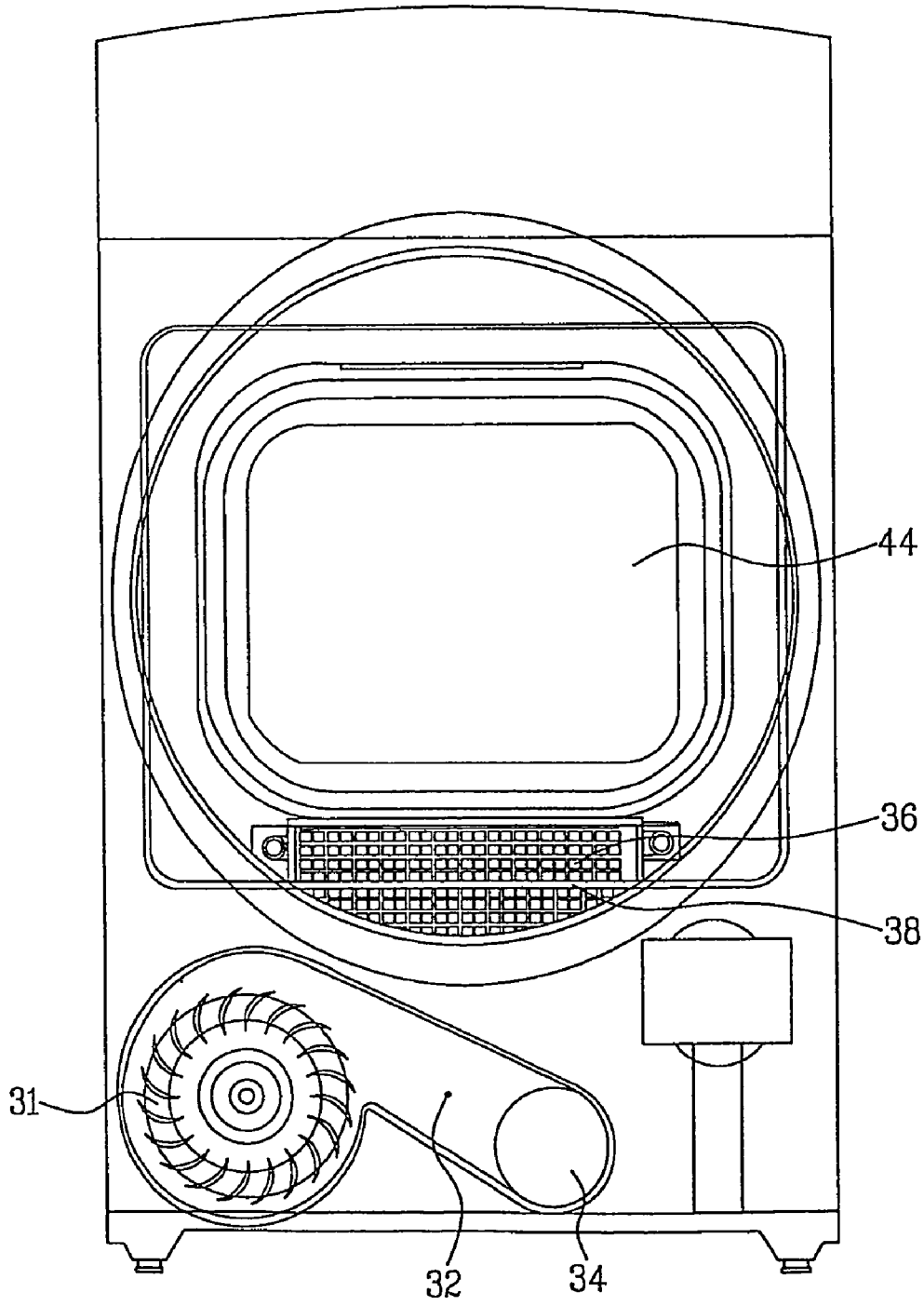
FIG.2 Related Art
FIG. 2 is a plan view of the general drier.
Figure 3:
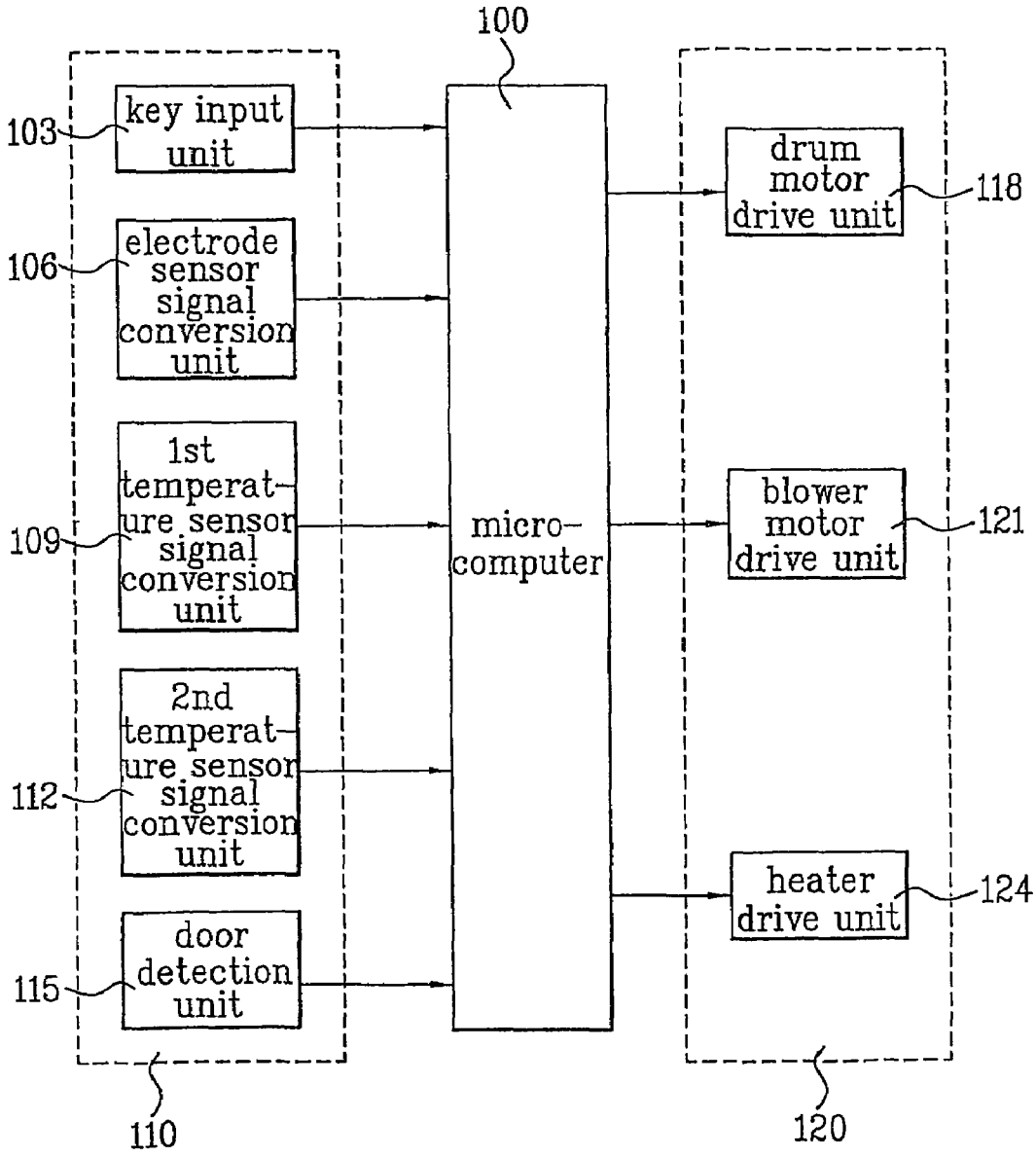
FIG. 3 Related Art
FIG. 3 is a block diagram of components used in controlling the general drier.
Figure 4:
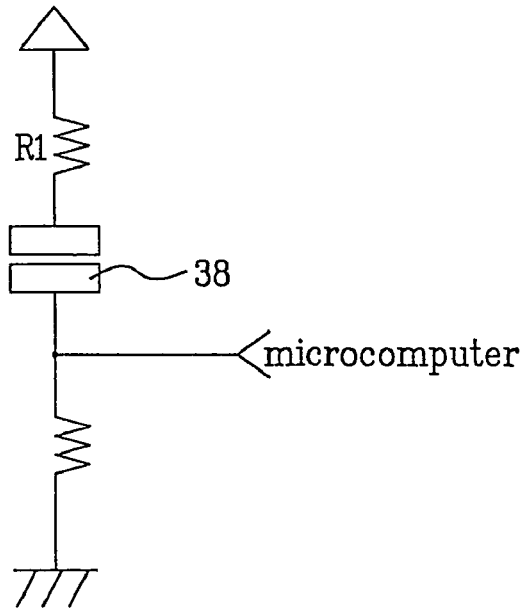
FIG. 4 Related Art
FIG. 4 illustrates a construction of a second temperature sensor signal conversion unit shown in FIG. 3.
Figure 5:
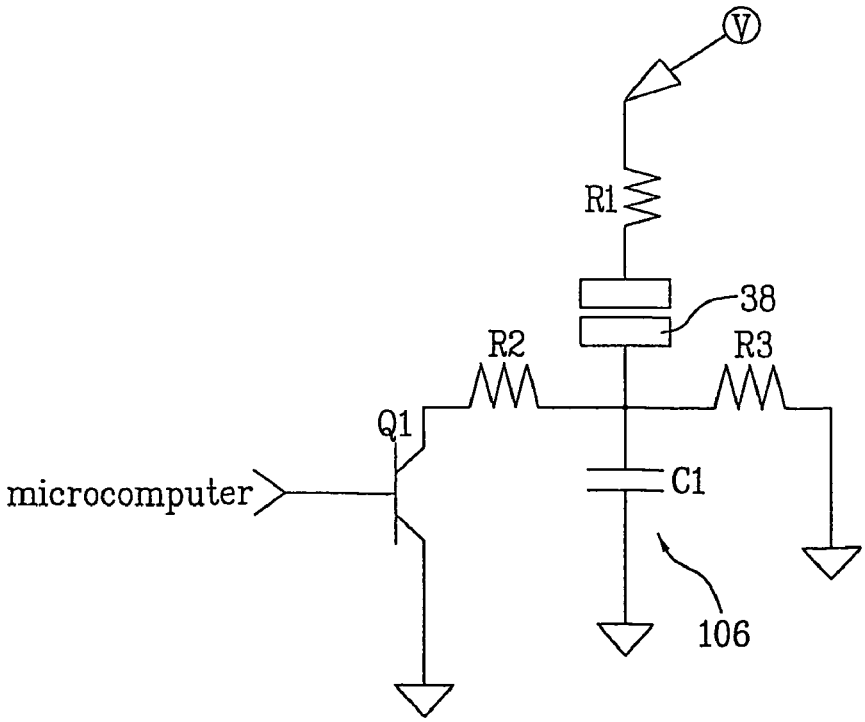
FIG. 5 illustrates a construction of a dryness measuring device in a drier according to the invention.

FIG. 5 illustrates a construction of a dryness measuring device in a drier according to the invention, in which such a construction of the drier necessary for explanation will be referred to FIGS. 1 to 3.

Referring to FIG. 5, in the dryness measuring device of the invention, an electrode sensor 38 and a capacitor C1 are connected to a resistor R1, respectively, in series so that the voltage charged in the capacity C1 is varied with the resistance value of the electrode sensor 38.

A discharging circuit is disposed between the electrode sensor 38 and the capacitor C1.

The discharging circuit includes a resistor R2 and a transistor Q1 functioning as a switching device. When the transistor Q1 is turned on under the control of the microcomputer 100, the charged voltage of the capacitor C1 is discharged. The transistor Q1 has a turn-on period which is controlled by the microcomputer 100. The voltage charged in the capacitor C1 is provided to the microcomputer 100 via a resistor R3.

The drier of the invention constructed as above has a following dryness measuring process.

Hereinafter, there will be described an operational process of the drier of the invention constructed as above.

A user primarily loads laundry into the drum 44 so as to dry laundry. The user closes a door, and selects a dry mode from the key input unit 103. A signal selected corresponding to the dry mode is inputted into the microcomputer 1.00. The microcomputer 100 recognizes the dry mode of the drier in response to the selected signal, and outputs a drum drive signal to the drum motor drive unit 118. As the drum motor (not shown) is actuated, the drum drive belt 54 is rotated and accordingly the drum 44 is rotated.

The microcomputer 100 outputs a blower motor drive signal to the blower motor drive unit 121. The blower assembly 30 is operated in response to the blower motor drive signal, and the operation of the blower motor assembly 30 drives the blower 31. As the blower 31 is driven, air in the drum 44 is exhausted to the exhaust duct 34 via the lint filter 36.

When the blower 31 exhausts air out of the drum 44, external air is sucked into the drum 44 via the feed duct 46. Owing to heat generation of the heater 42 at an entrance of the feed duct 46, air is heated up to a predetermined temperature while it is being introduced from the external environment into the drum 44. That is, the heater 42 heats air, which is introduced under the suction force of the blower 31, before it is fed into the drum 44.

After introduced into the drum 44, air absorbs moisture from laundry and then flows to the exhaust passage 45 via the exhaust hole. Moisture-containing air is exhausted to the outer environment under the suction force of the blower 31, which is driven in response to the operation of the blower assembly 30. After flowing to the exhaust passage 45, air is exhausted to the outer environment via the exhaust duct 34. The suction force of the blower 31 allows the air to be exhausted from the drum 44 through the exhaust hole 43. The lint filter 36 purifies air passing through the exhaust hole 43 such that foreign particles (e.g. seam and fluff of laundry) contained in the air are not transferred into the blower assembly 30.

The microcomputer 100 has a number of reference values set up according to types of objects to be dried and the dryness thereof. While air is circulating within the drum 44, the resistance value of the electrode sensor 38 is varied whenever the objects are in contact with the electrode sensor 38. Based upon the resistance value, a variable detection value is outputted.

The microcomputer 100 turns on the transistor Q1 in the discharging circuit shown in FIG. 5 at a given time point before measuring the dryness of laundry. This operation permits the voltage charged in the capacitor C1 to be discharged. Upon completing discharge of the capacitor C1, the microcomputer 100 controls the transistor Q1 into a turn-off mode again so as to prevent later discharge of the charged voltage in the capacitor C1 according to the dryness to be detected.

At a time point when the above operation has minimized any external influence for measuring the current dryness, the microcomputer 100 detects a voltage, which is divided by the variable resistance value of the electrode sensor 38 and charged into the capacitor C1, via the resistor R3. The detected voltage value is determined as the current dryness by the microprocessor 100.

As set forth above, the invention repeatedly discharges and charges the dryness measuring circuit for a predetermined period in order to measure the dryness, thereby minimizing the external influence in dryness measurement.

The electrode sensor signal conversion unit 106 converts a value detected by the electrode sensor 38 via discharging and charging for a predetermined period into a signal readable by the microprocessor 100, and transfers the signal into the microprocessor 100. The microprocessor 100 determines the current dried condition of laundry based upon variation of the voltage values detected by the electrode sensor 38.

In addition, the microcomputer 100 detects the temperature of hot air fed into the drum 44 via the first temperature sensor 48 and a signal detected by the first temperature sensor signal conversion unit 109, and detects the temperature of hot air exhausted from the drum 44 via the temperature sensor 32 and a signal detected by the second temperature sensor signal conversion unit 112. That is, the microcomputer 100 comprehensively judges the value detected by the electrode sensor 38 as well as the temperature of hot air introduced/exhausted into/from the drum 44 so as to determine the dryness of laundry. When the comprehensively judged value reaches a predetermined value, the microcomputer 100 stops the heater 42.

In addition to stopping the heater 42, the microcomputer 100 interrupts the blower drive signal, which the microcomputer 100 has been providing to the blower motor drive unit 121 so far. The blower drive signal is interrupted to cut off power toward the blower 31, thereby stopping the blower 31.

As set forth above, in detection of the dryness, the drier of the invention detects variation of the voltage charged in the capacitor based upon variation of the resistance when laundry is in contact with the electrode sensor. The charged voltage is discharged from the capacitor for every predetermined period to minimize the external influence.

Accordingly, the present invention has a fundamental technical spirit in that the electrode sensor is utilized to detect the current dryness of laundry and the current dryness is measured based upon variation of the voltage which is charged in the capacitor according to variation of the resistance value of the electrode sensor. It is also to be understood that those skilled in the art can make various modifications and variations without departing from the spirit and scope of to the invention.

INDUSTRIAL APPLICABILITY

According to the present invention as set forth above, the dryness measured during the automatic dry mode in the drier has no external influence so as to further improve precision in detection. This allows the drier of the invention to prevent under-heat or over-heat via improvement in detection precision, thereby improving the dried condition of laundry as well as preventing damage of laundry. Furthermore, enhanced dryness can advantageously improve reliability and quality of an article.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A dryness measuring device comprising:

a drum rotatably disposed for receiving objects to be dried therein;

a detection means for detecting the dryness of the objects, the detection means including an electrode sensor which is disposed such that the objects contact the electrode sensor, a capacitor for charging a voltage according to a resistance variation which occurs when the objects touch the electrode sensor, and a discharging circuit for discharging the charged voltage from the capacitor; and a control means for activating the discharging circuit to discharge the charged voltage of the capacitor and calculating the dryness based on a variation of a voltage which is newly charged into the capacitor.

2. The dryness measuring device of claim 1, wherein the electrode sensor is connected to the capacitor in series.

3. The dryness measuring device of claim 1, wherein the discharging circuit is connected to an access point between the capacitor and the electrode sensor.

* * * * *